US006831024B2

(12) United States Patent
Kim

(10) Patent No.: US 6,831,024 B2
(45) Date of Patent: Dec. 14, 2004

(54) GOLD LAYER-LAMINATED FABRIC AND METHOD FOR FABRICATING THE SAME

(75) Inventor: Sun-Ki Kim, Gyonggi-do (KR)

(73) Assignees: AMIC Co., Ltd., Gyeonggi-do (KR); Chul-Soo Choi, Busan (KR)

( * ) Notice: Subject to any disclaimer, the term of this patent is extended or adjusted under 35 U.S.C. 154(b) by 204 days.

(21) Appl. No.: 10/332,073

(22) PCT Filed: Mar. 3, 2001

(86) PCT No.: PCT/KR01/00328

§ 371 (c)(1),
(2), (4) Date: Jan. 2, 2003

(87) PCT Pub. No.: WO02/02861

PCT Pub. Date: Jan. 10, 2002

(65) Prior Publication Data

US 2003/0102225 A1 Jun. 5, 2003

(30) Foreign Application Priority Data

Jul. 3, 2000 (KR) ..... 2000/18971 U
Jul. 3, 2000 (KR) ..... 2000/37748

(51) Int. Cl.[7] ..... B32B 15/14

(52) U.S. Cl. ..... 442/317; 428/615; 428/617; 428/618; 428/670; 428/671; 428/674; 428/156; 442/4; 442/6; 442/16; 442/21; 442/23; 442/27; 442/50; 442/51; 442/52; 442/58; 442/183; 442/228; 442/231; 442/232; 442/233; 442/376; 442/378; 442/379; 442/394

(58) Field of Search ..... 442/4, 6, 16, 21, 442/23, 27, 50, 51, 52, 58, 183, 228, 231, 232, 233, 317, 376, 378, 379, 394; 428/600, 606, 615, 617, 618, 670, 671, 674, 675, 74

(56) References Cited

U.S. PATENT DOCUMENTS 6,569,789 B1 * 5/2003 Shioda et al. ..... 442/221

* cited by examiner

*Primary Examiner*—Arti R. Singh
(74) *Attorney, Agent, or Firm*—Dann, Dorfman, Herrell and Skillman; Henry H. Skillman

(57) ABSTRACT

The conductive fabric is fabricated by preparing a base fibrous fabric substrate having the form of a woven, non-woven, or mesh sheet, forming a first layer formed on the fibrous fabric substrate in accordance with an electroless plating process, the first layer being made of copper, and forming a second layer as an externally exposed layer, on the first layer continuously, the second layer being made of gold or platinum.

8 Claims, 4 Drawing Sheets

GOLD-PLATED FABRIC 1

GOLD-PLATED FABRIC 2

GOLD LAYER-LAMINATED FABRIC AND METHOD FOR FABRICATING THE SAME

BACKGROUND OF THE INVENTION

1. Field of the Invention

The present invention relates to a gold layer-laminated fabric and method for fabricating the same, and more particularly, to a fabric fabricated by plating a copper layer and a gold or platinum layer on a fibrous fabric substrate continuously, thereby permitting the fabric to have superior thermal conductivity, electrical conductivity, moth repellency, and antibacterial potency. Moreover, this present invention relates to a method for fabricating a fabric by plating a copper layer and a gold or a platinum layer on a fibrous fabric substrate.

2. Description of the Related Art

Conductive fabric has been originally developed by the National Aeronautic and Space Administration (NASA) for the purpose of a prevention of erroneous operations of aerospace equipment allowing no error. Currently, such conductive fabrics are applied to all industrial fields in order to provide a good protection for the human body and to avoid a loss resulting from erroneous operations of industrial appliance.

An example of a conventional conductive fabric is a fabric having an electromagnetic shield layer formed by spraying or coating a mixture of conductive carbon, copper, manganese, and adhesive onto a fabric substrate. However, such a fabric has drawbacks in that the process capability, venting capability, and flexibility thereof, which are the intrinsic characteristics of fabrics, are degraded because the electromagnetic shield layer is formed using a method of directly spraying or coating the mixture on the fabric substrate, even though it provides a shielding effect against electromagnetic waves.

Fabric products have also been developed, in which an outermost layer thereof externally exposed is made of nickel, copper, carbon, or silver. In the case using nickel, an allergic reaction may occur when the outermost layer is in prolonged contact with the skin. In the case, there is also a problem of corrosion or decoloration. Furthermore, this product exhibits degraded thermal and electrical conductivities. In fabric products using copper or silver, there is a problem of corrosion or decoloration. In the case using carbon, there is a problem in that very degraded thermal and electrical conductivities are exhibited.

Generally, garments made of fabrics with metal coatings have been developed only to provide a specific function such as an electromagnetic shield function, without taking into consideration the health of wearers or the aesthetic appeal of those garments. Furthermore, the recent advance in radio communications results in a demand for functional garments having functions associated with radio communications. However, there is no practical product associated with such functional garments.

Therefore, an object of the invention is to provide a fabric exhibiting superior venting capability, moth repellency, antibacterial potency, thermal conductivity, and electrical conductivity.

Another object of the invention is to provide a fabric exhibiting no decoloration and while being harmless to the human body and exhibiting metallic brilliance.

Another object of the invention is to provide a fabric capable of avoiding an allergic reaction, harmful to the body of the wearer, caused by an inner layer thereof exposed due to the peel-off of an outermost layer thereof.

Another object of the invention is to provide a method for fabricating a fabric capable of accomplishing the above mentioned objects.

SUMMARY OF THE INVENTION

In accordance with one aspect, the present invention provides a conductive fabric comprising: a fibrous fabric substrate having the form of a woven, non-woven or mesh sheet; a first layer of copper formed on the fibrous fabric substrate by an electroless plating process; a second layer gold or platinum formed, as an externally exposed layer, on the first layer continuously. The conductive fabric may further comprise a third layer made of nickel and interposed between the fibrous fabric substrate and the first layer, the third layer being formed by an electroless plating process.

The nickel and copper layers may be formed using an electroless plating process whereas the gold or platinum layer may be formed using either an electrolytic plating process or an electroless plating process. Preferably, the nickel layer has a thickness of 0.1 to 0.2 cm, the copper layer has a thickness of 0.3 to 0.7 cm, and the gold or platinum layer has a thickness of 0.05 to 0.2 $\mu$m.

The fibrous fabric substrate may be made of a fiber selected from the group consisting of polyester fibers, acrylic fibers, and polyamide fibers. The fibrous fabric substrate is made of a fiber having a form of a mono-filament or a multi-filament.

In accordance with another aspect, the present invention provides a method for fabricating a conductive fabric, the method comprises the step of: preparing a fibrous fabric substrate fabricated using a polyester-based fiber made of a condensation polymer of a terephthalic acid and an isopropyl alcohol; applying 80 to 90 g/l of a sodium hydroxide to the fibrous fabric substrate, and conducting an etching process for the fibrous fabric substrate at a temperature of 80° C. partially to remove the terephthalic acid; applying a hydrochloric acid to the fibrous fabric substrate to neutralize the sodium hydroxide, and then applying a complex salt consisting of a palladium chloride (PdCl2), a tin chloride (SnCl2), and a hydrochloric acid (HCl) to the fibrous fabric substrate to substitute the complex salt for locations from which the terephthalic acid is removed; applying a sulphuric acid to the fibrous fabric substrate at a temperature of about 40 to 60° C. to metallize a palladium existing in an ionized state in the fibrous fabric substrate; washing the fibrous fabric substrate, and applying a cuprous chloride, a formalin, a Rochelle salt, a citrate, an ethylene diamine tetraacetic acid (EDTA), and a sodium hydroxide to the fibrous fabric substrate to form a copper layer on the fibrous fabric substrate; and applying a potassium gold cyanids, an EDTA, a citrate, and an aqueous ammonia to the fibrous fabric substrate to form a gold layer on the copper layer.

Preferably, the copper layer is formed to have a thickness of 0.3 to 0.7 $\mu$m in accordance with an electroless plating process conducted, using the cuprous chloride in a concentration of about 10 to 30 g/l, the formalin in a concentration of about 10 to 30 g/l, the Rochelle salt in a concentration of about 5 to 10/l, the citrate in a concentration of about 5 to 10 g/l, the EDTA in a concentration of about 20 to 30 g/l, and the sodium hydroxide in a concentration of about 5 to 10 g/l, at a temperature of about 40 to 50° C. and a ph of 12.0 to 13.0. Preferably, the gold layer is formed to have a thickness of 0.05 to 0.2 $\mu$m in accordance with an electroless plating process conducted, using the potassium gold cyanide in a concentration of about 0.5 to 2 g/l, the EDTA in a concentration of about 15 to 25 g/l, the citrate in a concentration of about 15 to 25 g/l, and the aqueous ammonia in a concentration of about 10 to 30 ml/l.

Alternatively, the formation of the gold layer it carried out in accordance with an electrolytic plating process conducted using a potassium gold cyanide in a concentration of about 60 to 80 g/l, a cobalt in a concentration of about 0.7 to 0.9 g/l, and a conductive salt in a desired concentration, at a temperature of 20 to 50° C. and a pH of 3.8 to 4.3.

In order to provide an increased bonding force of the copper layer to the fibrous fabric substrate, nickel exhibiting an electrical conductivity similar to that of activated palladium ions may by plated on the fibrous fabric substrate. The nickel layer may be formed to have a thickness of 0.1 to 0.2 μm in accordance with an electroless plating process using a nickel sulfate, a sodium hypophospite, and a citrate. Preferably, the formation of the nickel layer is carried out in accordance with an electroless plating process conducted, using the nickel sulfate in a concentration of about 10 to 20 g/l, the sodium hypophospite in a concentration of about 7.5 to 15 g/l, and the citrate in a concentration of about 15 to 30 g/l, at a temperature of about 0.30 to 40° C.

DETAILED DESCRIPTION OF THE PREFERRED EMBODIMENTS

Hereinafter, a conductive fabric according to the present invention and a method for fabricating the conductive fabric will be described in conjunction with preferred embodiments thereof.

Figure 1:
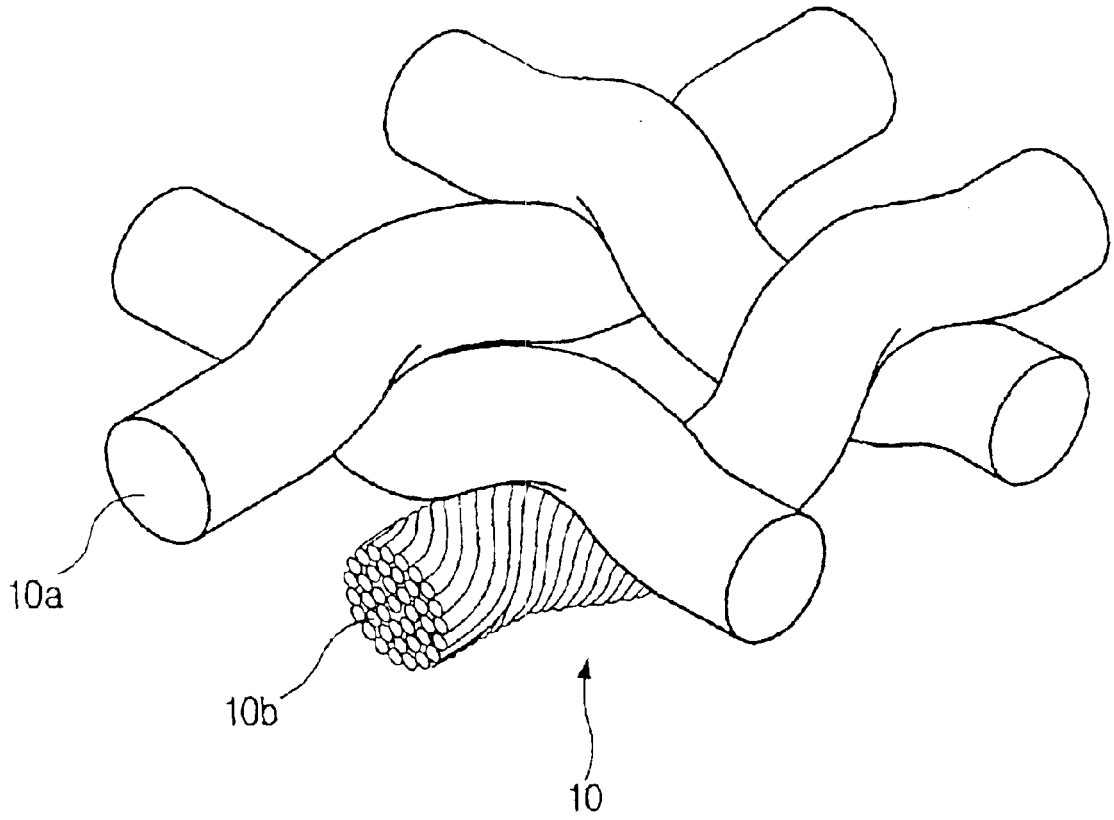
FIG. 1 is an exploded perspective view illustrating a part of a fabric according to the present invention.

FIG. 1 is an enlarged perspective view illustrating a part of a fabric according to the present invention.

As shown in FIG. 1, the fabric, which is denoted by the reference numeral 10, is fabricated to have the form of a woven, non-woven, or mesh sheet, using a processed fiber. The fiber may have form of a mono-filament 10*a* consisting of a single filament or a multi-filament 10*b* consisting of twisted filaments. Preferably, the fiber used in the present invention is made of a resin material selected from polyester, acrylic, and polyamide resins.

Figure 2:
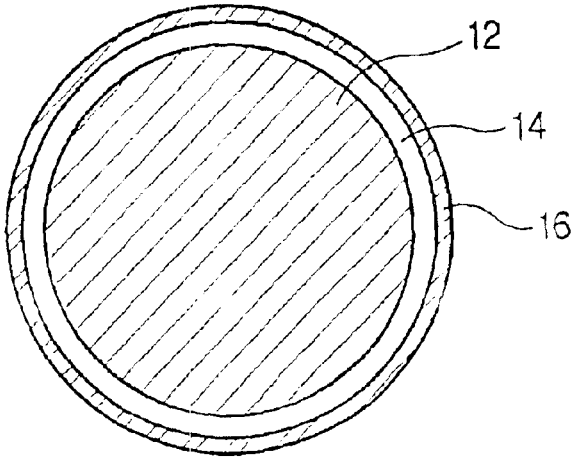
FIG. 2 is a cross-sectional view taken along the line 2—2 of FIG. 1.

FIG. 2 is an cross-sectional view taken along the line 2—2 of FIG. 1.

Referring to FIG. 2, a fibrous fabric substrate 12 is shown, on which copper is plated to form a copper layer 14. In accordance with an embodiment of the present invention, the plating of copper on the fibrous fabric substrate 12 is carried out in an electroless plating process. Preferably, the copper layer 14 has a thickness of 0.3 to 0.7 μm.

As mentioned above, the fibrous fabric substrate 12 is made of a fiber having the form of a mono-filament or a multi-filament. Where the fibrous fabric substrate 12 is made of a fiber having the form of a multi-filament, an increased plating area is provided because the plating is conducted for the multi-filament fiber twisted together. In this case, accordingly, improvements in bonding force and flexibility are obtained.

Gold or platinum is then plated on the copper layer 4, thereby forming a gold or platinum layer 16. The plating of this gold or platinum layer 16 can be conducted using either an electroless plating method or an electrolytic plating method. Preferably, the gold or platinum layer 16 has a thickness of 0.05 to 0.2 μm. In this thickness range, the final product can have a desired surface resistance of 0.01 to 5.0 Ωand a desired surface thermal conductivity of 0.1 to 5.0 cal/cm ·sec ·° C. In order to have a high purity, the gold or platinum 16 is made of a gold or platinum extracted, to have a purity of 99.9% or more, by dissociating a gold or platinum salt in water, thereby ionizing the salt, and then applying chemical or electrical energy to the ionized salt.

In accordance with the illustrated embodiment of the present invention, various advantages are provided.

First, it is possible to avoid an allergic reaction even when gold or platinum layer, which is the outermost plated layer of the fabric, is partially peeled off. This is because the skin of the wearer comes in contact with the copper layer exposed due to the partial peel-off of the gold or platinum layer.

Also, the amount of gold or platinum used to form the gold or platinum layer can be reduced because superior electrical and thermal conductivities are obtained by the copper layer plate on the substrate fiber. Since the copper layer has a sufficient thickness capable of allowing a formation of the gold or platinum layer using an electrolytic plating method, the manufacturing costs can also be considerably reduced.

Since the outermost layer coming into direct contact with the body of the wearer is constituted by the gold or platinum layer, it is possible to rapidly outwardly discharge heat emitted from the body of the wearer by virtue of the superior thermal conductivity of the gold or platinum layer. A uniform temperature distribution on the fabric can also be kept.

It is also possible to discharge static electricity generated between the fabric and the wearer's body because the gold or platinum layer exhibits a superior electrical conductivity. This results in an effect of avoiding shocks caused by static electricity.

Furthermore, there is an effect of promoting the circulation of blood in the wearer's body by virtue of gold or platinum ions of the gold or platinum layer coming into direct contact with the body. The gold or platinum layer has a function of neutralizing the poison effects, so that it provides effects of moth repellency and antibacterial potency suppressing a propagation of bacteria.

Since the outermost layer of the fabric is made of gold or platinum, peculiar metallic brilliance of gold or platinum is provided without any corrosion or discoloration.

Where the fabric is applied to garments, a remarkable improvement in flexibility is obtained because the gold or platinum has a good ductility.

Figure 3:
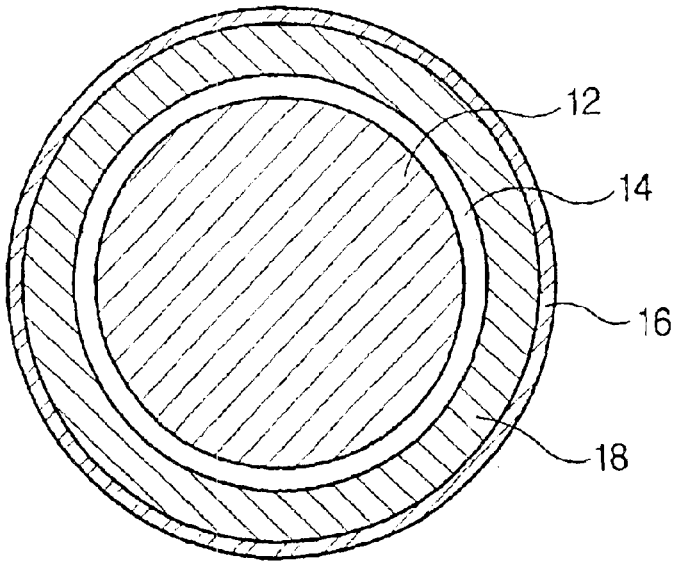
FIG. 3 is a cross-sectional view illustrating a fabric according to another embodiment of the present invention.

Referring to FIG. 3, a fabric according to another embodiment of the present invention is illustrated.

This fabric is different from that of the above mentioned embodiment in that a nickel layer 18 is interposed between the fibrous fabric substrate 12 and the copper layer 14. The nickel layer 18 is plated on the fibrous fabric substrate 12 in an electroless plating fashion. Preferably, the nickel layer 18 has a thickness of 0.1 to 0.3 μm.

The reason why the nickel layer 18 is interposed between the fibrous fabric substrate 12 and the copper layer 14 is to provide an increased bonding force of the copper layer 14 to the fibrous fabric substrate 12. That is, nickel can be strongly bonded to the fibrous fabric substrate 12 because there is a small transition difference between metallic palladium (Pd) and nickel adhering to the surface of the fibrous fabric substrate 12 during an electroless plating process.

Although nickel is applied to the fibrous fabric substrate in accordance with embodiment, it is possible to avoid an allergic reaction caused by the nickel. This is because the nickel layer is maintained in a shielded state by the copper layer plated thereon even when the gold or platinum layer is partially peeled off, so that only the copper layer may come into contact with the body of the wearer.

Figure 4:
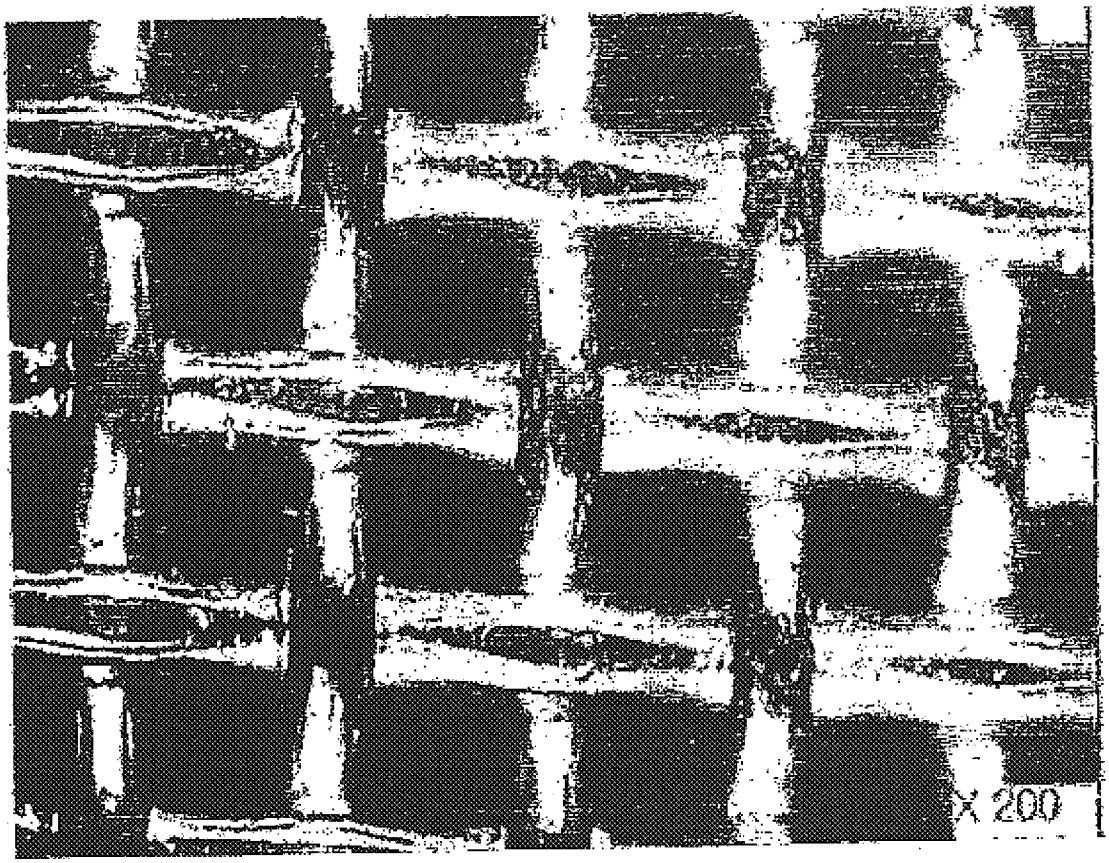
FIG. 4 is a SEM photograph of a fabric fabricated using a mono-filament in accordance with the present invention.
Figure 5:
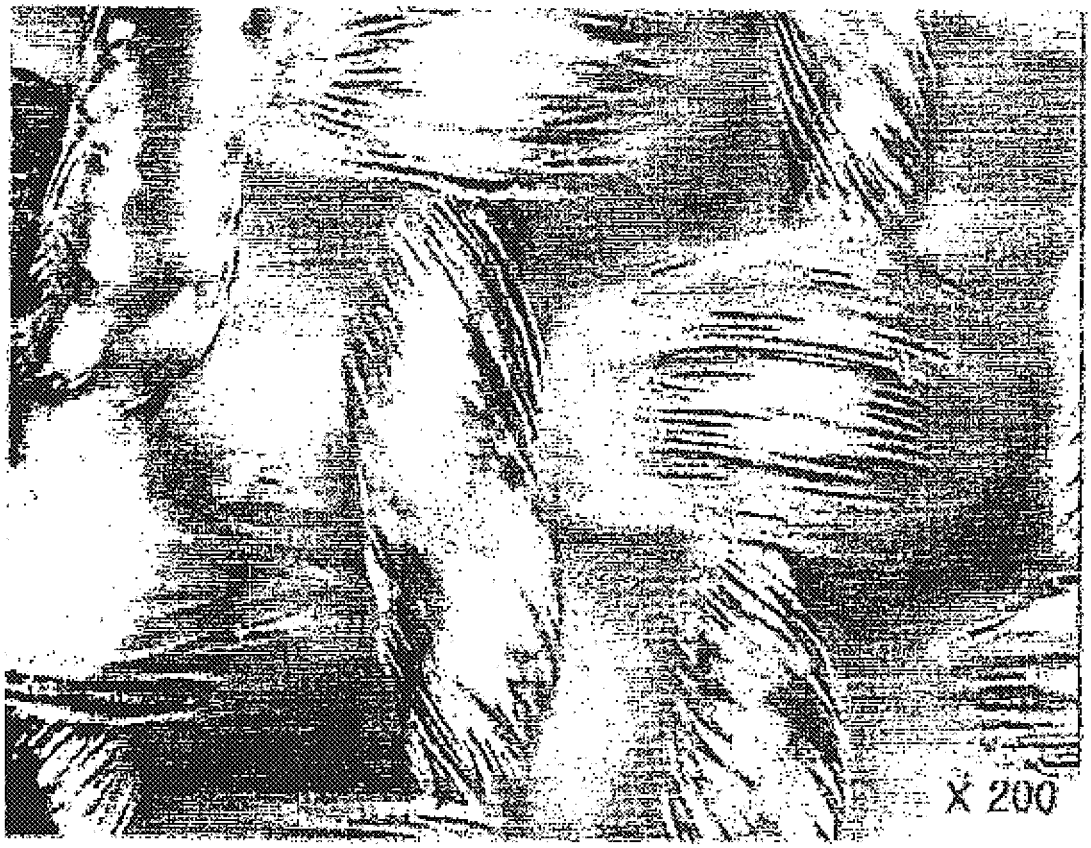
FIG. 5 is a SEM photograph of a fabric fabricated using a multi-filament in accordance with the present invention.

Meanwhile, FIGS. 4 and 5 are SEM photographs of fabric respectively fabrication using a mono-filament and a multi-filament, in accordance with the present invention.

A method for fabricating the fabric having the above mentioned structure in accordance with the present invention will be described.

In accordance with this embodiment, a fibrous fabric substrate is first fabricated to have the form of a woven, non-woven or mesh sheet, using a polyester-based fiber made of a condensation polymer of terephthalic acid and isopropyl alcohol. The fiber may have the form of a mono-filament consisting of a single filament or a multi-filament consisting of twisted filaments. Although any fiber may be used, a polyester-based fiber is preferred in accordance with the present invention.

Sodium hydroxide is applied, in a concentration of 80 to 90 g/l, to the fibrous fabric substrate in order to obtain an improvement in bonding force in a subsequent plating process. At etching process is then conducted at a temperature of 80° C. in order to partially remove the terephthalic acid. Following the etching process, the fibrous fabric substrate is washed.

After the washing process, a 10% hydrochloric acid is applied to the fibrous fabric substrate to neutralize the remaining sodium hydroxide. The resultant fibrous fabric substrate is then washed. Thereafter, a complex salt consisting of 2 g/l of palladium chloride (PbCl2), 2 g/l of tin chloride (SnCl2), and a 10% hydrochloride acid is applied to the fibrous fabric substrate to conduct a catalysis for substituting the complex salt for locations from which terephthalic acid is removed. By virtue of the catalysis, palladium ion nuclei are formed so as to provide a conductivity to the fibrous fabric substrate which is a non-conductor. Following the catalysis, the resultant fibrous fabric substrate is washed.

Subsequently, a 10% sulphuric acid is applied to the fibrous fabric substrate at a temperature of about 40 to 60° C. in order to activate palladium from an ionized state into a metallized state. Alternatively, 100 g/l of sodium hydroxide and a 10% sulphuric acid are applied to the fibrous fabric substrate at room temperature. The resultant fibrous fabric substrate is then washed.

Thereafter, an electroless plating process is carried out, using about 10 to 30 g/l of cuprous chloride, about 10 to 30 g/l of formalin, about 5 to 10 g/l of Rochelle salt, about 5 to 10 g/l of citrate, about 20 to 30 g/l of ethylene diamine tetraacetic acid (EDTA), and about 5 to 10 g/l of sodium hydroxide, at a temperature of about 40 to 50° C. and a pH of 12.0 to 13.0, thereby forming a copper layer over the fibrous fabric substrate. Preferably, the copper layer has a thickness of 0.3 to 0.7 μm. The resultant structure is then washed.

In order to form a gold layer on the copper layer, an electroless plating process is then carried out, using about 0.5 to 2 g/l of potassium gold cyanide, about 15 to 25 g/l of EDTA, about 15 to 25 g/l of citrate, and about 10 to 30 ml/l of aqueous ammonia, at a temperature of about 80 to 90° C. for 1 to 3 minutes.

Alternatively, the formation of the gold layer may be achieved in accordance with an electrolytic plating process conducted using about 6 to 7 g/l of potassium gold cyanide, about 60 to 80 g/l of citrate, about 0.7 to 0.9 g/l of cobalt, and other conductive salts of desired amounts at a temperature of 20 to 50

° C. and pH of 3.8 to 4.3. Where the electrolytic plating process is used, it is possible to reduce the amount of gold used, thereby achieving a reduction in the costs. This can be realized by sufficiently thickening the copper layer serving as a under support layer for the gold layer, thereby obtaining a reduction in electrical resistance.

Preferably, the gold layer has a thickness of 0.05 to 0.2 μm.

Although the copper layer is directly plated over the fibrous fabric substrate in the illustrated embodiment, a nickel layer may be interposed between the fibrous fabric substrate and the copper layer. In this case, the nickel layer provides an advantage of improving an improved bonding effect of the copper layer because nickel is strongly bonded to the activated palladium ions on the surface of fibrous fabric substrate.

The formation of the nickel layer is achieved by conducting an electroless plating process using about 10 to 20 g/l of nickel sulfate, about 7.5 to 15 g/l of sodium hypophospite, and about 15 to 30 g/l of citrate at a temperature of 30 to 40° C. and a pH of 8 to 9, thereby depositing nickel over the fibrous fabric substrate. Preferably, the nickel layer has a thickness of 0.1 to 0.3 μm.

In accordance with the method of the present invention, the gold layer can have a small thickness by, appropriately adjusting the thickness of the copper layer. By virtue of a superior electrical conductivity obtained by the thickness adjusted copper layer, it is possible to apply an electrolytic plating process to the formation of the gold layer. Accordingly, it is possible to reduce the amount of gold used, thereby achieving a reduction in the costs.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A conductive fabric comprising:

a fibrous fabric substrate;

a first layer of copper formed on the fibrous fabric substrate by an electroless plating process; and a second layer of gold or platinum formed on the first layer continuously and exposed to the outside.

2. The conductive fabric according to claim 1, further comprising a third layer of nickel interposed between the fibrous fabric substrate and the first layer and formed by an electroless plating process.

3. The conductive fabric according to claim 2, wherein the first layer has a thickness of 0.3 to 0.7 μm, the second layer has a thickness of 0.05 to 0.2 μm, and the third layer has a thickness of 0.1 to 0.3 μm.

4. The conductive fabric according to claim 1, wherein the second layer is formed by a selected one of an electroless plating process and an electrolytic plating process.

5. The conductive fabric according to claim 1, wherein the fibrous fabric substrate is made of a fiber selected from the group consisting of polyester fibers, acrylic fibers, and polyamide fibers.

6. The conductive fabric according to claim 1, wherein the fibrous fabric substrate is made of a fiber having a form of a mono-filament.

7. The conductive fabric according to claim 1, wherein the fibrous fabric substrate is made of a fiber having a form of a multi-filament.

8. The conductive fabric according to claim 1, wherein the fibrous fabric substrate has a form selected from the group consisting of a woven form, a non-woven form, and a mesh form.

* * * * *

UNITED STATES PATENT AND TRADEMARK OFFICE

CERTIFICATE OF CORRECTION

PATENT NO. : 6,831,024 B2
DATED : December 14, 2004
INVENTOR(S) : Kim

It is certified that error appears in the above-identified patent and that said Letters Patent is hereby corrected as shown below:

Column 2,
Line 23, "0.2 cm" should be -- 0.2 $\mu$m --;
Line 24, "0.7 cm" should be -- 0.7 $\mu$m --.

Signed and Sealed this

Twenty-second Day of February, 2005

JON W. DUDAS
*Director of the United States Patent and Trademark Office*